US005314778A

United States Patent [19]

Smith et al.

[11] Patent Number: 5,314,778

[45] Date of Patent: May 24, 1994

[54] TONER COMPOSITIONS CONTAINING COMPLEXED IONOMERIC MATERIALS

[75] Inventors: Thomas W. Smith, Penfield; David J. Luca, Rochester; Paul C. Julien, Webster, all of N.Y.

[73] Assignee: Xerox Corporation, Stamford, Conn.

[21] Appl. No.: 896,035

[22] Filed: Jun. 9, 1992

[51] Int. Cl.[5] ..... G03G 9/087

[52] U.S. Cl. ..... 430/111; 430/110

[58] Field of Search ..... 430/106, 110, 137, 111

[56] References Cited

U.S. PATENT DOCUMENTS

| | | | |
|---|---|---|---|
| 3,893,935 | 7/1975 | Tadwin et al. | 252/62.1 |
| 4,206,064 | 6/1980 | Kiuchi et al. | 430/106 |
| 4,252,921 | 2/1981 | Merrill et al. | 525/437 |
| 4,298,672 | 11/1981 | Lu | 430/108 |
| 4,299,898 | 11/1981 | Williams et al. | 430/106 |
| 4,338,390 | 7/1982 | Lu | 430/106 |
| 4,411,974 | 10/1983 | Lu et al. | 430/106 |
| 4,415,646 | 11/1983 | Gruber et al. | 430/110 |
| 4,426,436 | 1/1984 | Lewis et al. | 430/137 |
| 4,592,989 | 6/1986 | Smith et al. | 430/110 |
| 4,904,762 | 2/1990 | Chang et al. | 430/110 |
| 4,925,763 | 5/1990 | Tsubuko et al. | 430/106 |
| 4,925,764 | 5/1990 | Madeleine et al. | 430/110 |
| 4,925,765 | 5/1990 | Madeleine et al. | 430/110 |
| 4,937,157 | 6/1990 | Haack et al. | 430/110 |
| 5,102,763 | 4/1992 | Winnik et al. | 430/110 |
| 5,145,518 | 9/1992 | Winnik et al. | 106/21 |

FOREIGN PATENT DOCUMENTS

438746A1 7/1991 European Pat. Off. .

OTHER PUBLICATIONS

"Carrier Coating with Inomeric Resins"; P. G. Horton; Xerox Disclosure Journal, vol. 2, No. 1, Jan./Feb. 1977; p. 75.

*Primary Examiner*—John Goodrow

*Attorney, Agent, or Firm*—Zosan S. Soong

[57] ABSTRACT

A toner composition comprised of resin particles, pigment particles, and submicron colloidal domains of an ionomeric polymer or an interpolymer complex comprising a first polymer and a second polymer, preferably, independently selected from the group consisting of an ionophoric polymer and the ionomeric polymer. The ionomeric polymer and interpolymer complex are optionally complexed to a Lewis acid, a salt, or an ion thereof.

28 Claims, 3 Drawing Sheets

TONER COMPOSITIONS CONTAINING COMPLEXED IONOMERIC MATERIALS

BACKGROUND OF THE INVENTION

This invention is generally directed to toner compositions and developer compositions useful in electrostatographic imaging systems including color imaging processes. More specifically, the present invention is directed to toner compositions containing therein, as charge control agents, certain ion-binding polymers.

Electrostatographic processes, and more specifically the xerographic process, are well known as documented in several prior art references. This process involves development of an electrostatic latent image by applying toner particles to the image to be developed using, for example, cascade development, magnetic brush development, and touchdown development. The toner particles applied can be charged negatively or positively, depending upon the charge deposited on the photoreceptor surface and whether image or background areas are exposed to light. Thus, for example, when it is desired to develop an area which is negatively charged relative to the developer housing bias, the toner particles are positively charged usually by incorporating therein certain charge enhancing additives. In contrast, when developing an area which is positively charged relative to the developer housing bias, the toner particles are negatively charged usually by incorporating therein charge control agents which will cause the toner particles to assume negative charges thereon.

In modern xerographic developers, additives known as charge control agents ("CCAs") are used to modify charge levels, charge distribution, admix characteristics and developer life. Problems accompanying the use of CCAs range from shortfalls in their ability to impact this array of properties In a beneficial manner to incompatibility with other subsystems (e.g., photoreceptor and fuser). Pigments, including carbon blacks, organic and inorganic colorants and magnetic particles ($Fe_3O_4$, $\gamma$-$Fe_2O_3$) tend to have a dominant effect on the charging characteristics of a toner or developer. Accordingly, one of the most significant shortfalls in the use of charge control agents for color xerography is the necessity of formulating different compositions whenever the pigments in the toner are changed. Even with effective charge control agents one is often limited in choice of colorant.

Various toner formulations are known:

Winnik et al., U.S. Pat. No. 5,102,763 (issued Apr. 7, 1992), discloses a dry toner composition which comprises a resin, hydrophilic silica particles having dyes covalently bonded to the particle surfaces through silane coupling agents, and a polymer having at least one segment capable of enhancing the dispersability of the silica particles in the resin and at least one segment capable of adsorbing onto the surface of the silica particles. In one embodiment, the polymer segment capable of adsorbing onto the surface of the silica particles is ionophoric and capable of complexing with a salt, thereby incorporating a toner charge control additive into the polymer.

Tsubuko et al., U.S. Pat. No. 4,925,763 (issued May 15, 1990), discloses a developer which comprises toner particles containing therein at least an ionomer resin, which toner particles may comprise a colorant which is prepared by a flushing method by using a pigment component and an ionomer resin, when necessary, with addition thereto of a humic acid component.

Madeline et al., U.S. Pat. No. 4,925,764 (issued May 15, 1990), discloses positively chargeable toner containing block copolymers, which allegedly improves compatibility with the toner resin. Preferred are block copolymers of styrene with methyl methacrylate and butyl methacrylate as one block and dimethylaminoethyl methacrylate as the other block, quaternized with methyl tosylate or benzyl chloride. Phase separation, if any, is discussed for example in Example V, Comparison V, and Comparison VI.

Madeline et al., U.S. Pat. No. 4,925,765 (issued May 15, 1990), discloses negatively chargeable toner containing block copolymers, which allegedly improves compatibility with the toner resin. Preferred are block copolymers of styrene, methyl methacrylate and butyl methacrylate as one block and salts or esters of methacrylic acid or acrylic acid as the other block in the copolymer.

Smith et al., U.S. Pat. No. 4,592,989 (issued Jun. 3, 1986), discloses a toner composition containing resin particles, pigment particles, and a complex of a dipolar molecule or salt attached to an ionophoric polymer.

Lewis et al., U.S. Pat. No. 4,426,436 (issued Jan. 17, 1984), discloses a process for rapidly charging uncharged toner particles to a positive polarity.

Gruber et al., U.S. Pat. No. 4,415,646 (issued Nov. 15, 1983), discloses nitrogen containing polymers as charge enhancing additive for toners.

Williams, U.S. Pat. No. 4,299,898 (issued Nov. 10, 1981), discloses positively charged toners containing quaternary ammonium salts attached to acrylate polymers.

Horton, Xerox Disclosure Journal, Vol. 2, No. 1, p. 75 (January/February 1977), discloses a carrier coating with ionomeric resins.

Developer compositions with charge enhancing additives are well known. Thus, for example, there are described in U.S. Pat. Nos. 3,893,935; 4,937,157; and 4,904,762 the use of quaternary ammonium salts as charge control agents for electrostatic toner compositions. Also, there is disclosed in U.S. Pat. No. 4,338,390 developer compositions containing as charge enhancing additives organic sulfate and sulfonates, which additives can impart a positive charge to the toner composition. Further, there is disclosed in U.S. Pat. No. 4,298,672 positively charged toner compositions with resin particles and pigment particles, and as charge enhancing additives alkyl pyridinium compounds. Moreover, toner compositions with negative charge enhancing additives are known, reference for example U.S. Pat. Nos. 4,411,974 and 4,206,064. The '974 patent discloses negatively charged toner compositions comprised of resin particles, pigment particles, and as a charge enhancing additive or-tho-halo phenyl carboxylic acids. Similarly, there are disclosed in the '064 patent toner compositions with chromium, cobalt, and nickel complexes of salicylic acid as negative charge enhancing additives.

Accordingly, there thus continues to be a need for improved charge control agents for incorporation into toner compositions and developer compositions. Additionally, there continues to be a need for charge control agents which effectively eliminate or passivate the contribution of pigments or other toner constituents to the triboelectric properties of positive and negative charging toner compositions. Also, there continues to be a need for toner and developer compositions which contain charge control agents that are non-toxic, do not adversely affect fuser rolls, and in particular Viton® fuser rolls selected for use in electrostatographic imaging systems, are thermally stable; and wherein the charge control agents are immobile. Additionally, there is a need for charge control agents which can be prepared by a simple direct, economical process, thereby decreasing the cost of the toner compositions generated. Furthermore, there continues to be a need for toner compositions which will rapidly charge new uncharged toner particles which are added to a positively charged toner composition or negatively charged toner compositions. Moreover, there continues to be a need for toner compositions comprised of charge control agents which will allow development of electrostatic latent images, either positively charged or negatively charged, with a wide spectrum of toner resins.

SUMMARY OF THE INVENTION

It is an object of the present Invention to provide toner compositions and developer compositions.

It is a further object of the present invention to provide toner compositions and developer compositions which charge positively or negatively.

It is another object of the present invention to provide positive and negative charging toner compositions and developer compositions which exhibit "charge pinning." Charge pinning occurs when the charge control agent effectively passivates the triboelectric contributions of pigment and impurities to the triboelectric properties of the toner composition and developer and thus these triboelectric properties are fixed or pinned by the nature of the charge control agent.

It is an additional object of the present invention to provide toner compositions and developer compositions possessing expanded latitude in toner and developer processing and which exhibit good admix and good pigment dispersion.

These and other objects of the present invention are accomplished in embodiments by providing a toner composition comprised of resin particles, pigment particles, and submicron colloidal domains of an ionomeric polymer or an interpolymer complex comprising a first polymer and a second polymer dispersed in the toner resin. The ionomeric polymer and interpolymer complex are optionally complexed with a salt, a Lewis acid, or an ion of the salt or the Lewis acid. Also contemplated in the present invention is a developer composition, toner plus carrier.

BRIEF DESCRIPTION OF THE DRAWINGS

Other aspects of the present invention will become apparent as the following description proceeds and upon reference to the Figures which show schematic flow diagrams of embodiments of the present invention.

In FIG. 2, the dashes represent pigment premixed with ionomeric polymer and the solid lines represent one-step mixing.

In FIG. 3, the dashes represent spray dry processing, the solid lines represent melt processing with solution predispersion, and the dotted lines represent direct precipitation processing.

DETAILED DESCRIPTION

Figure 1:
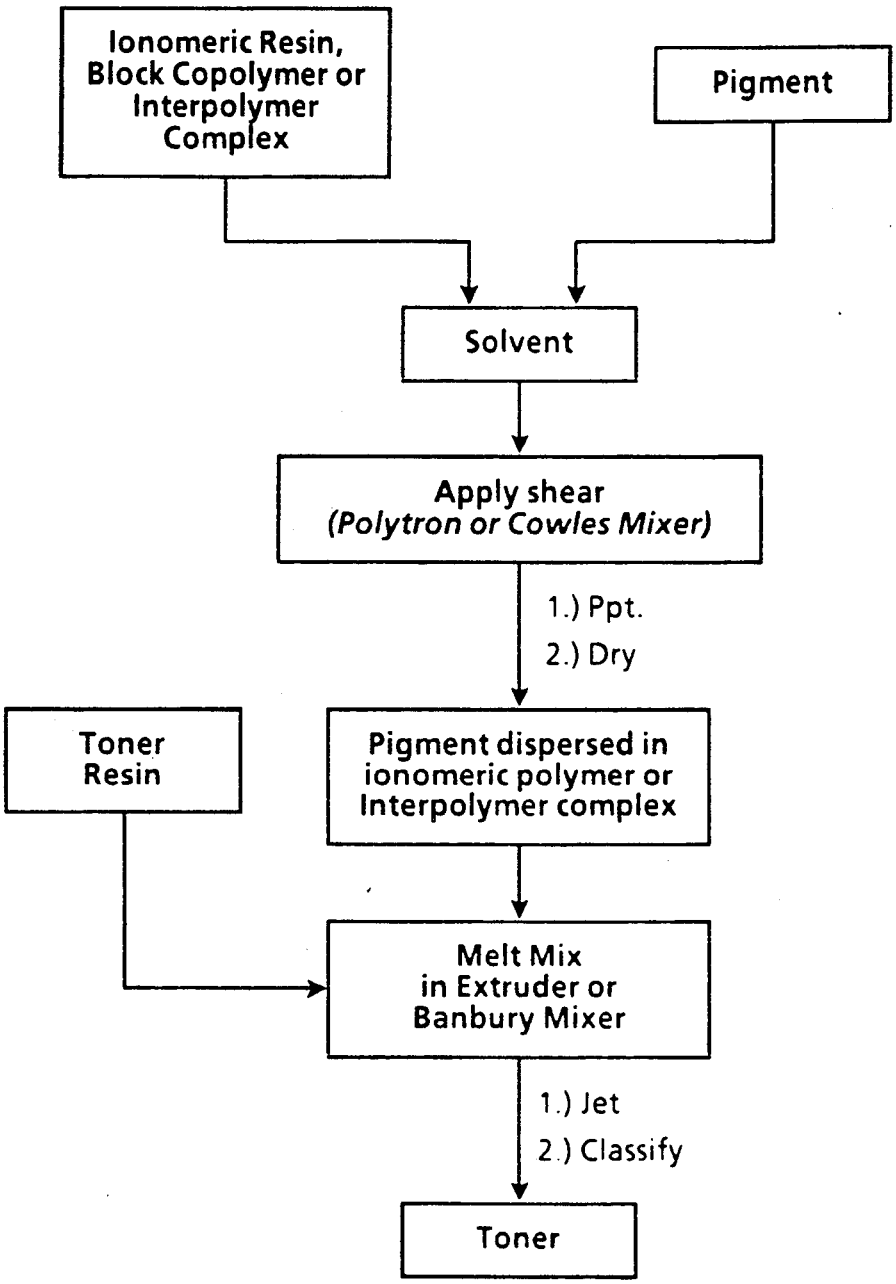
FIGS. 1, 2, and 3 outline three representative methods for preparation of the toner and developer compositions of the present invention.

The ionomeric polymers that can be employed in the present invention include homopolymers, copolymers, and terpolymers having ionizable groups. Ionizable homopolymers and copolymers with a high percentage of ionizable residues are often classified as poly(electrolytes). Copolymers containing a small percentage of ionizable residues (less than about 10% by weight) are often referred to as ionomers. Illustrative examples of ionomeric polymers with various types of ionizable groups include the following general classes. The salt forms with representative counterions (any suitable effective counterion can be used including halogens, alkali metals, alkaline earth metals, and transition elements) depicted herein are preferred but it is understood that the acid form of the ionomeric polymers is also within the scope of the present invention.

I. Ionomeric polymers containing anionic groups

A. sulfonic acid salts

1. I

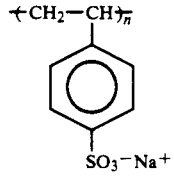

poly(sodium styrene sulfonate)

2. II

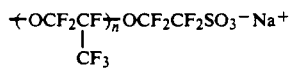

perfluoroethylene sulfonate derivative

B. Carboxylic acid salts

III

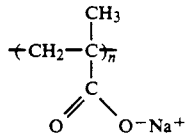

poly(sodium methacrylate)

C. Phosphonic acid salts

IV

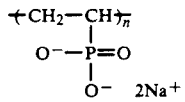

poly(vinyl sodium phosphonate)

II. Ionomeric polymers containing catonic groups

A. Ionomeric polymers containing ammonium groups

1. Integral quaternaries: These can be either on a linear chain or a cyclic (aliphatic or aromatic) species; in any case they form part of the backbone. V

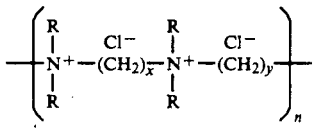

X,Y, ionene

VI

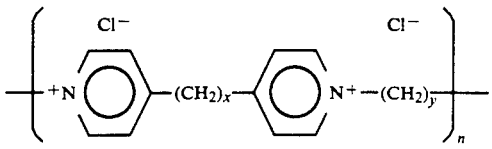

aromatic ionene (a polypyrazine)

-continued

VII

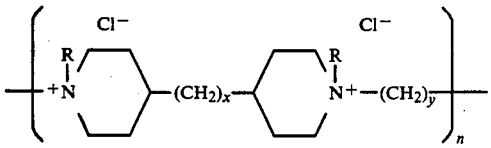

polypiperazine

2. Pendant quaternaries: The ionic groups may be attached to an aliphatic chain or to a cyclic backbone directly or through various intermediates. The quaternary ion itself may be aliphatic or part of a a heterocycle.

VIII

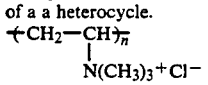

poly(vinyl trimethyl ammonium chloride)

IX

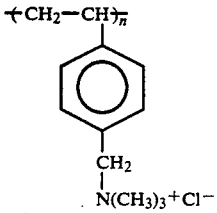

poly(vinyl benzyl trimethyl ammonium chloride)

X

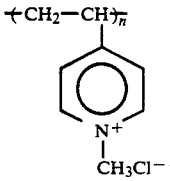

poly(N-methylvinylpyridinium chloride)

XI

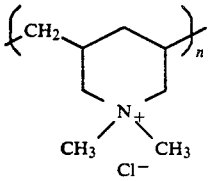

poly(diallyl dimethyl ammonium chloride)

B. Ionomeric polymers containing phosphonium groups

XII

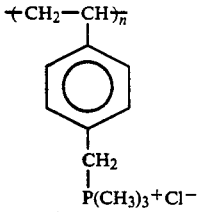

poly(vinyl benzyl trimethyl phosphonium chloride)

C. Ionomeric polymers containing sulfonium groups

XIII

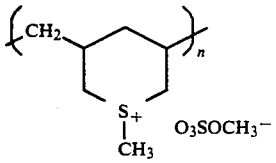

poly(methyldiallyl sulfonium methylsulfate)

In the above compounds, n is a number from 2 to about 10,000, and preferably 50 to about 5000; x and y are independently a number from 1 to about 25, preferably 2 to about 10; and R is a substituent selected from the group consisting of hydrogen, alkyl groups of from 1 to about 25 carbon atoms (such as methyl, ethyl and propyl and the like), aryl of from 6 to 24 carbon atoms, especially phenyl, chlorine, and cyclic alkyl of 3 to 24 carbon atoms (such as cyclopropyl, 3-methylcyclobutyl and cyclohexylene, and the like). Preferably, R is hydrogen or an alkyl group. It is understood that an ionomeric polymer may include more than one type of ionizable group, in which case, the different ionizable groups preferably all have the same polarity.

Preferably, the ionomeric polymers are in the form of a diblock copolymer (F-block-G) where one polymer segment (F) is miscible with the toner resin and the other polymer segment (G) is ionomeric. The segment miscible with the toner resin may be any polymer typically used as a toner resin and it may be the same or different from the toner resin. Suitable toner resins are discussed later. Charge pinning may be achieved by homoionomeric polymers, but advantageous admix properties may not be pronounced, particularly if the homopolymer is not well dispersed in the toner composition.

Suitable ionomeric polymers include: ethylene-methacrylic acid copolymers; butadiene-acrylic acid copolymer; perfluorosulfonate ionomers available as Nafion® from DuPont; perfluorocarboxylate ionomers available as Flemion® from Ashai Glass; sulfonated ethylene-propylene-diene terpolymer; styrene-acrylic acid copolymer; sulfonated polystyrene; alkyl methacrylate-sulfonate copolymers; styrene-based polyampholytes; and acid-amine ionomers.

The ionomeric polymers of the present invention, which generally are known compositions, can be prepared by a number of processes described in the literature, e.g., A. Eisenberg and M. King, Polymer Physics Vol. 2, Ion-Containing Polymers, Physical Properties and Structure, Academic Press, New York (1977) and references cited therein, the disclosures of which are totally incorporated by reference. For example, ionomeric polymers are prepared by the polymerization of ionizable monomers or by the derivatization of nonionic polymers to incorporate ionizable groups. Ionomeric polymers in which the ionizable group is a carboxylic acid group are generally prepared by the free-radical homopolymerization or copolymerization of vinyl monomers bearing carboxylic acid functionality. These monomers are typified by acrylic acid, methacrylic acid, itaconic acid, fumaric acid, maleic acid, 4-vinylbenzene carboxylic acid and the like. They can also be obtained by the polymerization or copolymerization and subsequent hydrolysis of vinyl monomers bearing ester, amide or nitrite functionality. These hydrolyzable monomers are typified by t-butylmethacrylate, trimethylsilylacrylate, acrylonitrile, and acrylamide.

Ionomeric polymers in which the ionizable group is a sulfonic acid group are commonly prepared by the free-radical homopolymerization or copolymerization of vinyl monomers bearing sulfonic acid or sulfonate salt functionality or by the sulfonation of styrenic polymers. AMPS, (2-acrylamido-2-methyl)propane sulfonic acid or its sodium salt, are commercially available monomers which are particularly suitable for free-radical polymerization.

Ionomeric polymers in which the ionizable group is a quaternary ammonium group are commonly prepared by derivatization of polyamines (polyvinylpyridine, polyvinylimidazole, polyethylene imine and the like). Polymerizable acrylic monomers bearing amino or quaternary amino functionality are commercially available (N,N-dimethylaminoethylacrylates, N,N-dimethylaminoethylacrylamides and their quaternary ammonium salts) and and can be copolymerized with other vinyl monomers to directly generate polymers with alkyl ammonium or quaternary ammonium functionalities. The ionenes are a special class of quaternary ammonium polymers prepared by the condensation polymerization of diamines and dihalides.

Other ionizable functionalities which have been incorporated into polymers, include: phosphonate, sulfonium, phosphonium, hydroxamate. Carboxylic acid-containing polymers are preferred on account of their facile free-radical polymerization and copolymerization and their ability to coordinate transition metal salts and be neutralized to specified percentages by alkali and alkaline earth metal hydroxides and oxides.

Two general methods are employed for the synthesis of diblock copolymers: (i) sequential polymerization by the successive addition of different monomers (the mechanism involved in each step of the polymerization may be radical, cationic or anionic; (ii) the end-to-end linkage of preformed polymers. Ionic block copolymers can be prepared by methods (i) and (ii) and by the chemical modification of a preformed neutral block copolymer. Since most ionic or ionizable monomers can only be polymerized by free-radical initiators, direct copolymerization usually entails the preparation of the first segment of the polymer and the functionalization of that segment with an end-group which is active as a free-radical initiator.

A number of processes for the preparation of block copolymers have been disclosed in the literature which proceed with the intermediacy of polymer chains end-functionalized as a free-radical initiator. These processes are discussed in the following references, the disclosures of which are totally incorporated by reference: C. W. Brown and G. A. Taylor, J. Appl. Polymer Sci., 13, 629 (1969); A. Ladousse, C. Filliatre, B. Maillard, C. Manigand and J. J. Villenave, European Polymer Journal, 15, 987 (1979); B. M. Baysal, W. T. Short and A. V. Tobolsky, J. Polym. Sci., A-1, 10, 898 (1972); and J. V. Crivello,j D. A. Conlon and J. L. Lee, J. Polym. Sci.:Pt A, 24, 1197 and 1251 (1986).

Ionophoric polymers that can be employed in the present invention are illustrated in U.S. Pat. No. 4,592,989, the disclosure of which is totally incorporated by reference. Suitable ionophoric polymers may be homopolymers, copolymers, or terpolymer, including the following: a carbon chain polymer with a pendant crown ether group; a copolymer of styrene and 4'-vinyl benzo 18'crown-6; a condensation polymer bearing an in-chain cyclic polyether, diaza polyether, or aza polyether group; an open chain polyether; a polystyrene-block-polyoxyethylene diblock polymer; a (styrene/2-methyl tetrahydrofuran 2,5 diyl)diblock polymer; a poly(tetrahydrofuran 2,5 diyl); and a poly(2-methyltetrahydrofuran 2,5 diyl).

The ionophoric polymers of the present invention, which generally are known compositions, can be prepared by a number of processes described in the literature. For example, the polymers with pendent cyclic or acyclic polyether functionalities, may be prepared by addition polymerization of vinyl or cyclic monomers with pendent cyclic or acyclic polyether groups. Also, analogous polymers can be prepared by polymer derivitization. Polymers with in-chain cyclic polyether residues are generally prepared by polycondensation reactions, while polymers with in-chain acyclic polyether segments are usually prepared by ring opening polymerizations. Moreover, 2,5 poly(tetrahydrofuran) diyl and its congeners ω-poly(cyclo-oxa-alkane) diyls, are prepared by epoxidation and ring expansion of certain alkylene containing polymers. The specific reaction parameters for obtaining the polymers involved are described in the following literature references, the disclosure of each being totally incorporated herein by reference: J. Appl. Polym. Sci, 20, 773 (1976); Ibid., 20, 1665 (1976); Macromolecules, 12, 1638 (1979); Makromol. Chem. Rapid Commun., 2, 161 (1981); JACS, 102 (27), 7981 (1980); J. Polym. Sci., Polym. Chem., 17, 1573 (1979); W. Dittmann and K. Hamann, Chemiker, 96, (1972), Nouveau Journal DeChemie, 6 (12), 623 (1982); Macromolecules, 13, 339 (1980); Z. Anal. Chem., 313, 407 (1982); J. Polym. Sci., Polymer Chem. Ed., 21, 855 (1983); Ibid, 21, 3101 (1983); Makromol. Chem., 184, 535 (1983); J. Polym. Sci., Pt. Al, 9, 817 (1974); Macromolecules, 12, 1038 (1979); Macromolecules, 6, 133 (1973); and Pure Appl. Chem., 57, 111 (1979).

Interpolymer complexes can also be employed in the present invention. The association of two or more different macromolecular chains in solution caused by secondary binding forces (electrostatic forces, ion-dipole forces, H-bonding, apolar bonding, charge-transfer, and the like) are generally called "intermacromolecular (interpolymer) complexes" or "polymer-polymer complexes." In the present invention, interpolymer complexes for control of charging characteristics in toners generally pertain to polyelectrolyte complexes, ion-dipole complexes and H-bonded complexes. Polyelectrolyte complexes are generally formed through Coulomb forces by mixing solutions of oppositely charged polyelectrolytes, i.e., polyanions and polycations. The complexes form spontaneously on mixing and often precipitate from solution. H-bonded complexes are generally formed by mixing solutions of polymers bearing proton-accepting units and proton donating units. The complexes again tend to form spontaneously and may precipitate from solution upon formation. Preparation of interpolymer complexes is illustrated in A. Rembaum, Appl. Polym. Symp. 22, 299 (1973); D. J. Worsfold, J. Polym. Sci., Polym. Chem. Ed. 12, 337 (1974); and A. Frank, Makromol. Chem 96, 258 (1966), the disclosures of which are totally incorporated by reference. The following Table gives a representative listing of known interpolymer complexes formed through electrostatic and H-bonded forces.

TABLE I

| Polymer A | Polymer B | Ref.* |
|---|---|---|
| | Interpolymer Complexes | |
| | Polyelectrolyte Complexes | |
| Poly(sodium styrene sulfonate) | Poly(4-vinylbenzyltrimethylammonium chloride) | 48-77 |
| | Quaternized poly(vinyl pyridine) | 78-80 |

TABLE I-continued

| Polymer A | Polymer B | Ref.* |
|---|---|---|
| | Interpolymer Complexes | |
| | Poly[1-(4-[2-(triethylammonio)ethyl]-phenyl)ethylene bromide] | 81–85 |
| | Poly(2-N,N-dimethylaminoethylmethacrylate) | 89,90 |
| | Poly(1,2-dimethyl-5-pyridinum methyl sulfate) | 91 |
| | Polyviologen | 92–94 |
| Poly(4-vinylbenzylamine dinitrobenzoyloxyphenol) | Poly dimethylvinylbenzylamine) | 95 |
| Poly(sodium vinyl sulfonate) | Poly(ethylene imine) | 97 |
| Poly(carboxylic acids) | Poly(ethylene imine) | 98–114 |
| | Poly(ethylenepiperazine) | 115 |
| | Poly(4-vinylpyridine) | 116–120 |
| | Poly(vinylbenzyltrimethylammonium chloride | 142,143 |
| | Quaternized poly(vinyl pyridine) | 144–149 |
| | Poly(2-N,N-dimethylaminoethylmethacrylate) | 115.150 |
| | Poly(vinylaminoacetal) | 151 |
| | H-Bonded Complexes | |
| Poly(carboxylic acids) | Poly(ethylene oxide) | 175–221 |
| | Poly(N-vinyl-2-pyrrolidone) | 222–261 |
| | Poly(vinyl alcohol) | 262–283 |
| | Poly(acrylamide) | 284.285 |
| | Poly(1,2-dimethoxyethylene) | 288–290 |
| | Poly(dimethyltetramethylene-phosphoric triamide) | 291–293 |
| | Poly(vinylmethyl ether) | 294 |
| | Poly(vinylbenzo-18-crown-6) | 295 |
| Poly(vinyl alcohol) | Poly(N-vinyl-2-pyrrolidone) | 296 |
| | Poly(acrylamide) | 297 |
| Poly(arylate) | Poly(ethylene oxide) | 298 |

*References are taken from E. Tsuchida and K. Abe, Advances in Polymer Science, 45, "Interaction Between macromolecules in Solution and Intermacromolecular Complexes, " Springer-Verlag, Berlin, Heidelberg, New York (1982), the disclosure of which is totally incorporated by reference.

It is understood that each polymer of the interpolymer complex may independently be a homopolymer, copolymer, or a terpolymer. The interpolymer complex preferably is a pseudo-block copolymer of the form (C-block-D . . . Interpolymer . . . E) that results when a block copolymer (C-block-D) forms a complex with ionophoric or ionomeric polymer (E). Polymer segment (C) is miscible with the toner resin and may be the same or different from the toner resin (suitable toner resins are discussed later). Polymer segment (D) may be an ionophoric or an ionomeric polymer. If both segments (D) and (E) are an ionomeric polymer, it is preferred that the ionizable groups are of opposite polarity, i.e. the ionizable group of one ionomeric polymer can form a cation and the ionizable group of the other ionomeric polymer can form an anion. Preferred interpolymer complexes include the following: polystyrene-block-polyoxyethylene/polyacrylic acid; polystyrene-block-polyacrylic acid/polyoxyethylene; and poly(styrene-block-acrylic acid)/Ionene.

It is believed that polyelectrolyte complexes are generally ionic conductors even without the binding of a salt or Lewis acid thereto. Thus, a toner composition containing a polyelectrolyte complex such as poly(styrene-block-acrylic acid)/Ionene may effect charge pinning. It is also believed that polyelectrolyte complexes may enable a toner composition to charge positively.

In the present invention a Lewis acid or salt may be bound by ionic bonding forces to an ionomeric polymer (including an ionomeric segment of an interpolymer complex) as a composite neutral molecule. However, it is possible for the cation of the Lewis acid or salt to be complexed to the ionizable group of the ionomer without the counterion.

The cation of the Lewis acid or salt is typically bound and incorporated into an ionophoric polymer of the interpolymer complex as a composite neutral molecule. The anion of the Lewis acid or salt remains in close proximity to the cation. While it is not desired to be limited by theory, it is believed that certain cations in view of their size fit well in the polymer matrix, and are selectively bonded to specific ionophoric sites by ion dipole and/or H-bonding forces.

Any suitable electron acceptor may be employed as the Lewis acid. Preferably, the Lewis acid is a metal halide (wherein the halogen is Cl, Br, and I), alkoxide having 1–25 carbon atoms (such as methoxy) or carboxylate, wherein the metal may be for example $Al^{3+}$, $Cd^{2+}$, $Zn^{2+}$, $Ga^{3+}$, $Ti^{4+}$, $Ti^{3+}$, $Zn^{3+}$, $Sn^{4+}$, $Sn^{2+}$, $Sb^{5+}$, $Bi^{3+}$, $Fe^{3+}$, or their hydrates. It is understood that because some Lewis acids are salts, the meanings for Lewis acid and salt may overlap. The Lewis acids which are salts may be called "Lewis acid salts."

Any suitable salt may be employed in the present invention such as alkali earth salts, alkaline earth salts, transition metal salts, and other similar salts providing the objectives of the present invention are satisfied. Specific examples of cations of the salts that can be bound and incorporated into the polymers illustrated herein are alkali earth metals like lithium, sodium, potassium, cesium, and rubidium; alkaline earth metals such as beryllium, calcium, strontium, magnesium, and barium; rare earth metals including Ce, Gd, Er, La, and Pr; while examples of specific transition metals that are useful include titanium, chromium, iron, silver, gold, mercury and the like. Also useful as cations are metals such as zinc, aluminum, and tin. Moreover, as cations, there can be selected ammonium compounds including ammoniums and alkyl ammonium salts of the formula $NH_4^+$, $NHR_3^+$, $NH_2R_2^+$ or $NH_3R^+$ wherein R, $R_2$ and $R_3$ are independent alkyl groups of from 1 to 24 carbons.

Typical anions of the salts include halides such as iodide, chloride, bromide, and fluoride; electronegative anions such as nitrate and perchlorate; organic anions such as citrate, acetate, picrate, tetraphenyl boride; complex anions such as ferricyanide, ferrocyanide, hexachloroantimonate, hexafluorophosphate, and tetrafluoroborate; electron rich anions such as hydroxide; and electron poor ions such as trifluoromethane sulfonic acid, hexafluorophosphate, hexafluorosilicate and carboxylate and oximate. The choice of anion can be an important factor in achieving the desired charging characteristics for the toner compositions selected.

The ionomeric polymers and interpolymer complexes of the present invention are preferably complexed with salts or Lewis acids. These polymers can be complexed with the salts and Lewis acids by a number of known methods or alternatively the carboxylic acid groups can be neutralized to the degree desired by simple titration with base. Thus, for example, poly(acrylic acid) and $ZnCl_2$ can be dissolved in a common solvent (methanol) and mixed in any of a wide range of proportions up to 1 mole of the $ZnCl_2$ per 1 mole of the poly(acrylic acid) to yield homogeneous solid solutions of $ZnCl_2$ in poly(acrylic acid). Poly(acrylic acid) residues may also be neutralized with ZnO or other metal oxides or hydroxides to yield metal carboxylate functionality.

The Lewis acid or salt is bound to the ion-binding polymer in an amount of from about 0.5 percent to about 100 percent depending on the binding capacity of the polymer, and preferably in an amount of from about 1 percent to about 50 percent. Regarding complexes with, for example, oxyalkylene residues, these complexes generally contain a minimum of 4 oxyalkylene residues per binding site. Additionally, the ion-binding polymeric charge control compositions of the present invention can be incorporated into the toner composition in various desired amounts, providing the objectives of the present invention are achieved. Generally, the ion-binding polymer, optionally complexed with a salt, Lewis acid, or ion thereof, of the instant invention is present in the toner in an amount of from about 0.5 percent to about 50 percent by weight of the toner composition. The concentration of the colloidal domains of the ionomeric polymer or the interpolymer complex in the toner resin is typically less than about 10% by weight, preferably less than about 5% by weight, of the toner composition. When the ion-binding polymers are in the form of diblock copolymers containing a segment miscible with the toner resin (i.e., a non-functional polymer segment), the amount of the diblock copolymer can approach about 20% by weight of the toner composition, particularly if the segment length of the non-functional block is large as compared to the ionomeric or ionophoric segment. These percentages by weight are for the ion binding polymer alone or complexed together with the Lewis acid, salt, or ion thereof.

Incorporation of the complexed ionomeric polymers and interpolymer complexes into toner compositions containing a toner resin and pigments yield materials whose triboelectric values are effectively determined by the type and amount of ion-binding polymer present as well as by the nature of the Lewis acid and salt complexed thereto. These compositions exhibit rapid admix, and good pigment dispersion, and their tribo is "pinned," i.e., the contribution of pigments and other constituents (such as impurities) to the charging characteristics of the composite is effectively eliminated or passivated.

As discussed previously, the ionomeric polymer is preferably a diblock copolymer, wherein the polymer segments are previously discussed, and the interpolymer complex is preferably a pseudo-block copolymer of the form (C-block-D . . . interpolymer . . . E), wherein (C), (D), and (E) are also previously discussed. The preferred diblock ionomeric copolymer embodiment or pseudo-block interpolymer complex embodiment, when blended into the toner resin which is miscible with one or another of the segments thereof, yield well defined, homogeneous colloidal dispersions of the immiscible components (i.e., the ionomeric and/or ionophoric segments).

Thus, the toner composition of the present invention has a micellar or pseudo two phase morphology, consisting of a phase (A) of the toner resin and a phase (B) comprised of the immiscible segments of the ion-binding polymer. These immiscible segments are also adsorbed on the pigment surface, thereby decreasing the tendency of the pigment particles to aggregate, and improving pigment dispersion. Complexation of a salt, Lewis acid, or ion thereof to the ionomeric and/or the ionophoric polymer segments renders phase (B) ionically semiconductive or conductive, and provides domains for localization of charge carriers in the toner composition. Thus, with bound ions, the phase (B) domains become ionically conducting and there is provided a morphology comprised of a uniformly dispersed colloidal conductive/semiconductive phase dispersed throughout the toner resin. This semiconductive/conductive phase (B) permits the charging characteristics (tribo, charge distribution and admix) of the toner composition to be determined by the amount of phase (B) (domain number, volume fraction and domain size) and the nature of the complexed Lewis acid or salt, rather than by the nature of the pigment or the other components of the toner. Thus, charge pinning occurs since the tribo value is independent of the nature of the pigment and is determined by the nature of the complexed ion binding polymer. Improved admix qualities are believed to be achieved by a "charge sharing process" which continually equalizes the charge on all toner particles in the developer. The propensity to "charge share" results from coulombic charging across the interface between the colloidal conductive/semiconductive phase and the toner resin. By varying the molecular weight of the ionomeric polymer and/or ionophoric polymer, it is believed that one may control the domain size of phase (B). The number density of phase (B) domains may be directly proportional to the concentration of the ionomeric polymer or interpolymer. The conductivity of phase (B) is determined by the kind and amount of Lewis acid or salt complexed and the tribo of the system is determined by the nature of the ion binding polymer and salt or Lewis acid complexed thereto. The colloidal domains typically have an average volume diameter of about 100 to about 1000 Angstroms, preferably less than about 500 Angstroms. Even though the pigment particles with adsorbed ionomeric and/or ionophoric polymer may be larger in size than the colloidal domains, the charging characteristics of the composition are determined by the colloidal domains. It is understood that only a portion of the ionomeric polymer or interpolymer complex is adsorbed on the surface of the pigment particles. The remainder of the ionomer polymer or interpolymer complex forms the submicron colloidal domains dispersed through the toner resin.

The micellar or pseudo two phase morphology of the instant invention may be formed by the following methods. When the ionomeric polymer is in a form of a diblock copolymer (F-block-G) or when the interpolymer complex is in the form of a pseudo-block copolymer (C-block-D . . . interpolymer . . . E), wherein F, G, C, D, and E are as previously defined, thermodynamically stable, micellar or pseudo two phase morphology will generally be formed spontaneously. Micellar phases, which develop spontaneously in F-block-G and C-block-D . . . interpolymer . . . E composites are very small (typically 10–100 nm in diameter) and can generally be visualized or measured only by transmission electron microscopy or low angle X-ray/light scattering.

When the ionomeric polymer and interpolymer complex are not a diblock copolymer or a pseudo-block copolymer as described above and are for example homopolymers, a process of mechanical dispersion and quenching may form a highly dispersed two phase colloidal morphology of fractional micron dimensions. This method is similar to conventional toner processing whereby the ionomeric polymer or interpolymer complex is mechanically dispersed in the toner resin by any suitable means including a high shear mixer or extruder. The resulting highly dispersed morphology, which is not thermodynamically stable is captured, "locked" in place by quenching the polymer melt to a glass. Colloidal composites of mechanically dispersed ionomeric polymers or interpolymer complexes can generally be visualized and measured by optical microscopy and light scattering techniques. Composites of ionomeric or interpolymeric complexes prepared mechanically will tend to be highly variable in their degree of dispersion. The interfacial tension between the polymeric phases and their relative melt viscosities at the processing temperature are the important control parameters.

Figure 2:
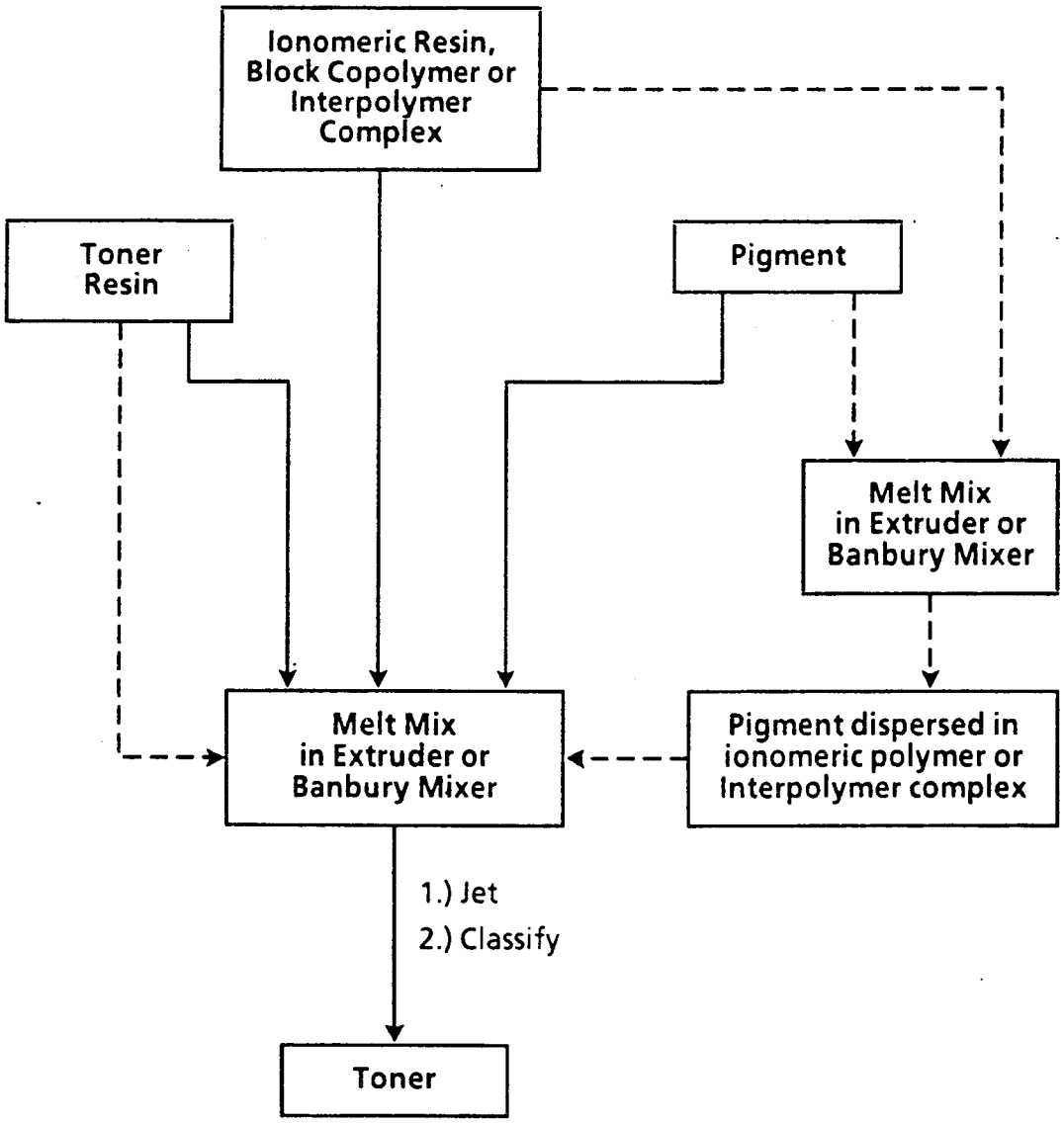
Figure 3:
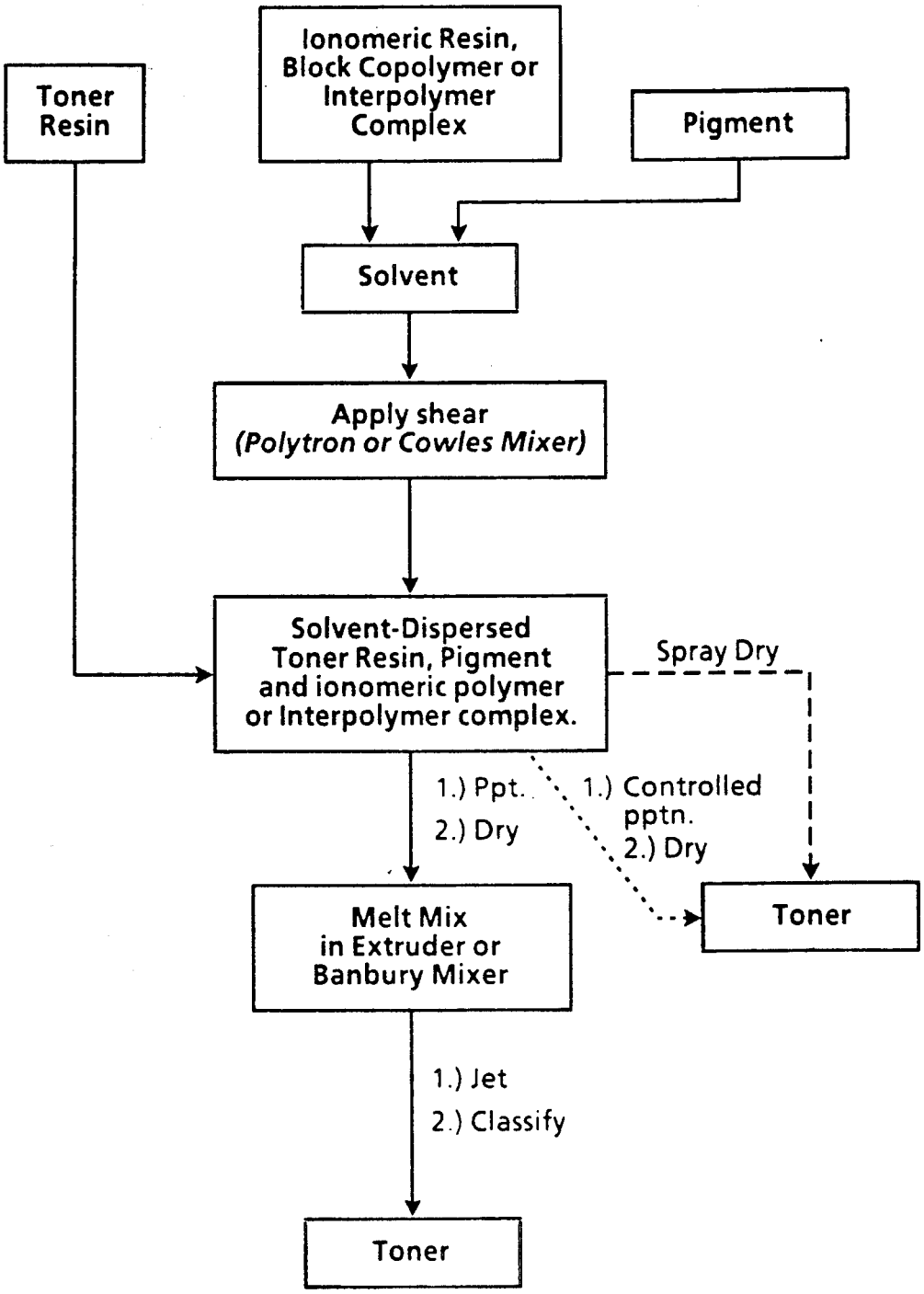

Numerous known methods can be selected for preparing the toner and developer compositions of the present invention. Thus, the toner compositions can be prepared by solution mixing, precipitation and drying of the polymeric resin, pigment particles, and as charge control additives the ion binding polymeric compositions of the present invention. Melt blending and mechanical attrition of the resin and pigment particles coated with the ion binding polymeric charge control additives of the present invention is a preferred method of preparation. Other processes for preparing the toner compositions of the present invention can be selected including, for example, spray drying of the aforementioned solution. The flow diagrams in FIGS. 1, 2 and 3 outline three representative methods for preparation of the toner and developer compositions of the present invention.

The toner resin is generally present in the toner composition in an amount providing a total sum of all toner ingredients equal to about 100 percent. Thus, when about 10 percent by weight of the ion binding polymeric composition of the present invention and about 5 percent by weight of colorant or pigment particles are present, about 85 percent by weight of the resin is included therein. Toners are subjected to known classification methods to enable toner particles with an average volume diameter of from about 3 microns to about 25 microns, preferably 5 microns to about 15 microns.

Developer compositions of the present invention can be prepared by mixing carrier particles with the toner composition in any suitable combination, for example, when about 1 part to about 10 parts of toner composition are mixed with from about 100 parts to about 200 parts by weight of carrier particles.

Various suitable resins may be selected for the toner compositions of the present Invention. Illustrative examples of typical toner resins include styrene butadiene copolymer, crosslinked resins including crosslinked polyesters (copending U.S. Ser. Nos. 07/814,641 and 07/814,782, the disclosures of which are totally incorporated by reference), styrene acrylates, styrene methacrylates, polyamides, epoxies, polyurethanes, vinyl resins, polycarbonates, polyesters, and the like. Any suitable vinyl resin may be selected including homopolymers or copolymers of two or more vinyl monomers. Typical of such vinyl monomeric units include: styrene, vinyl naphthalene, ethylenically unsaturated monoolefins such as ethylene, propylene, butylene, isobutylene and the like; vinyl esters such as vinyl acetate, vinyl propionate, vinyl benzoate, and vinyl butyrate; ethylenically unsaturated diolefins, like butadiene and isoprene; esters of unsaturated monocarboxylic acids such as methyl acrylate, ethyl acrylate, n-butylacrylate; isobutyl acrylate, dodecyl acrylate, n-octyl acrylate, phenyl acrylate, methyl methacrylate, ethyl methacrylate, and butyl methacrylate and the like; acrylonitrile, methacrylonitrile, vinyl ethers such as vinyl methyl ether, vinyl isobutyl ether, and vinyl ethyl ether; vinyl ketones inclusive of vinyl methyl ketone, vinyl hexyl ketone, and methyl isopropenyl ketone; and mixtures thereof. Also, there may be selected as toner resins various vinyl resins blended with one or more other resins, preferably other vinyl resins, which insure acceptable triboelectric properties and uniform resistance against physical degradation. Furthermore, it is believed nonvinyl type thermoplastic resins may also be employed including resin modified phenolformaldehyde resins, oil modified epoxy resins, polyurethane resins, cellulosic resins, polyether resins, polyester resins, and mixtures thereof.

Generally, toner resins with a relatively high percentage of styrene are preferred. The styrene resin may be a homopolymer of styrene or copolymers of styrene with other monomeric groups. Any of the above suitable typical monomeric units may be copolymerized with styrene by addition polymerization. Styrene resins may also be formed by the addition polymerization, including free radical, anionic, and cationic of mixtures of two or more unsaturated monomeric materials with styrene monomer.

Any suitable known pigment or dye, including carbon black like Regal® 330, magenta, cyan, and/or yellow particles as well as mixtures thereof, may be selected as the colorant for the toner particles. Such colorants include, for example, carbon black, magnetites, like Mapico black, a mixture of iron oxides, iron oxides, nigrosine dye, chrome yellow, ultramarine blue, duPont oil red, methylene blue chloride, phthalocyanine blue, and mixtures thereof. The pigment or dye should be present in the toner in a quantity sufficient to render it highly colored. Preferably, the pigment is present in amounts of from about 3 percent to about 50 percent by weight based on the total weight of toner. However, if the pigment selected is a dye, substantially smaller quantities, for example, less than 10 percent by weight, may be used. Suitable pigments and dyes are illustrated in U.S. Pat. No. 4,592,989, the disclosure of which is totally incorporated by reference.

The absolute value of the triboelectric charge present on the toner particles as determined by known methods like the Faraday cage and the charge spectrograph is preferably from about 10 microcoulombs per gram to about 50 microcoulombs per gram, and more preferably from about 15 microcoulombs per gram to about 35 microcoulombs per gram. Triboelectric plus or minus charge levels, within this range, may be achieved with the ion binding polymeric charge enhancing additives of the present invention. Triboelectric charge levels outside the ranges specified are also achievable with the complexed ionophoric polymers of the present invention.

Various suitable carrier materials are selected for formulating the developer composition of the present invention providing that these carrier particles are capable of triboelectrically obtaining a charge of opposite polarity to that of the toner particles. Examples of these carriers include materials such as glass, steel, nickel, ferrites like copper and zinc, silicon dioxide and the like, with metallic carriers, especially magnetic carriers being preferred. These carriers can be used with or without a coating, examples of coatings including resins such as polystyrene, homopolymers, copolymers, and terpolymers; polymers of halogen containing ethylenes including vinyl fluorides, vinylidene fluorides, vinyl chlorides, vinylidene chlorides, chlorotrifluoroethylene, a vinyl chloride/chlorotrifluoroethylene copolymer, a vinyl chloride/vinyl acetate copolymer, a chlorotrifluoroethylene polymer, and various known vinyl chloride terpolymers. Acrylic polymers and copolymers typified by polymethylmethacrylate and siloxane polymers are also useful carrier coatings, particularly when negative charging toners are desired. Coated carrier particles with a diameter of, for example, from about 25 to about 1,000 microns, preferably about 40 to about 150 microns, can be selected providing these particles with sufficient density and inertia to avoid adherence to the electrostatic image during the development process. Many of the typical carriers that can be used are described in U.S. Pat. Nos. 2,618,441; 2,638,522; 3,533,835; 3,526,533; 3,590,000; 3,847,604; 3,767,598; 4,233,387; 4,935,326; and 4,937,166, the disclosures of which are totally incorporated by reference.

While it is not desired to be limited by theory, in accordance with the present invention, the triboelectric charge polarity, that is, a positive or negative polarity can be primarily achieved by the selection of the toner resin or the polymer used to coat the carrier. Given that these polymers have been appropriately selected, the complexed ion-binding polymers of the present invention can be incorporated into the toner composition, the carrier coating or both the toner and the carrier coating. The magnitude of the aforementioned polarity is affected by the selection of the complexed ion-binding polymer. Also, the the carrier is chosen so as to facilitate the achievement of the desired charge level, negative or positive.

Charge pinning toner compositions can be obtained by incorporating the complexed ion-binding polymer of the present invention which result in a multiplicity of ionically conducting, submicron phases (which have affinity for and disperse and sequester pigments of varying kind) into toner resins. For negative charging toner compositions, the ionically conducting phase should comprise the lowest energy molecular entity for localization of a negative charge (an anion or radical anion). For positive charging toner compositions, the ionically conducting phase should comprise the lowest energy molecular entity for localization of a positive charge (a cation or radical cation).

Charge pinning may be achieved in negative charging toner compositions by complexing the ionomeric polymer or interpolymer complex with a Lewis acid or transition metal salt having an electron poor counterion. It is believed that transition metals form coordination complexes (square planar, tetrahedral, and octahedral) with the counterion and the ion binding polymer. Non-transition metals do not generally form coordination complexes, but instead form salts with the ionizable groups of the polymer. Preferred metal cations are those in Groups IIIA and the lanthanides, IVA, IIB, IIIB and IVB ( e.g. $SC^{3+}$, $La^{3+}$, $Ce^{3+}$, $EU^{3+}$, $Al^{3+}$, $Sn^{4+}$, $Zn^{2+}$, $Ti^{4+}$ and $Zr^{4+}$). Halide, trifluoromethane sulfonic acid, hexafluorophosphate, hexafluorosilicate and carboxylate and oximate are preferred counterions. Preferred ion-binding polymers for negative charging toner compositions are polystyrene-block-polyacrylic acid and polystyrene-block-polyoxyethylene/polyacrylic acid. Thus, for example, a negatively charging toner composition can be obtained when a copolymer of styrene and butadiene containing about 90% by weight of styrene and about 10% by weight of butadiene is used as the toner resin in combination with a carrier consisting of a steel core coated with a terpolymer of styrene/methylmethacrylate and a silane monomer. The level of negative charging can be dramatically enhanced and admix and charge pinning characteristics can be imparted to the toner by incorporating, for example, 10% by weight of a block copolymer of polystyrene (which may be abbreviated "PS") and copoly(butylacrylate/acrylic acid) complexed with $ZnCl_2$ into the toner composition.

Charge pinning may be achieved in positive charging toner compositions by incorporating the ionomeric polymer or interpolymer complex of the present invention, optionally complexed with a cation of a salt having a relatively electron rich counterion, e.g., alkali metal and alkaline earth metal hydroxides. These hydroxides increase the basicity and neutralize the acidic protons, e.g., carboxylic acid groups, of the ion-binding polymer. Also, in sufficient concentration, alkali metal hydroxides (e.g., NAOH and KOH) and alkaline earth metal hydroxides (e.g., $Ca(OH)_2$) may make the toner composition charge positively and may effect charge pinning. Thus, as an example, a positive charging toner composition can be obtained with the same copolymer of styrene and butadiene containing about 90% by weight of styrene and about 10% by weight of butadiene being used as the toner resin but in combination with a carrier consisting of a steel core coated with a mixture of polyvinylidene fluoride and poly(methyl methacrylate) wherein the ratio of PVF2 to PMMA is adjusted to achieve the desired tribo. The propensity of the toner to charge positively can be dramatically enhanced and admix and charge pinning characteristics can be imparted to the toner by incorporating, for example, 10% by weight of a block copolymer of PS and copoly(butylacrylate/acrylic acid) which has been extensively neutralized with potassium hydroxide into the toner composition. Alternatively, the interpolymer complex of a substantially neutralized block copolymer of polystyrene and copoly(butylacrylate/acrylic acid) with poly(ethylene (mine) or quaternized poly(vinyl pyridine) would also serve to enhance the propensity of the toner to charge positively, admix and pin charging characteristics.

While block copolymers are preferred because of their ability to yield a multiplicity of ionically conducting, submicron phases (which have affinity for and disperse and sequester pigments of varying kind), ionomeric polymers themselves are effective when they disperse or are induced to disperse as submicron phases in the toner resin. Thus, 1–2% by weight of polyacrylic acid complexed with $ZnCl_2$ and dispersed mechanically in a polyester toner resin can yield a negative charging toner composition which is rapidly admixing and exhibits charge pinning characteristics. Poly(acrylic acid) substantially neutralized with potassium hydroxide or the interpolymer complex of poly(acrylic acid) with poly(ethylene imine) or quaternized poly(vinyl pyridine), when dispersed as submicron phases in a polyester toner resin, can yield a positive charging toner composition which is rapidly admixing and exhibits charge pinning characteristics.

It is generally accepted that the magnitude of charge exchange between dissimilar materials on contact is related to the relative work functions of this contacting surfaces. The work function of materials in turn may be conveniently determined from Kelvin type contact potential measurements. Accordingly, the charge control characteristics of the ion-binding polymers of the present invention and their use in designing developer compositions are perhaps best illustrated by measurements of the contact potential of various composites of these ion-binding polymers (with and without bound salts or Lewis acids) with toner resins. Blends of polystyrene-block-poly(oxyethylene) and poly(acrylic acid) yield interpolymer complexes which are effectively pseudo-block copolymers. Contact potential difference measurements indicate that these pseudo-block copolymers might be effective negative charge control agents in themselves or complexed with Lewis acids. Yellow toners incorporating certain of these compositions as CCAs show that inherently negative charging and rapid admixing toners can be formulated as seen in the following Table (as used herein, PS-b-POE indicates polystyrene-block-poly(oxyethylene); PAA indicates poly(acrylic acid); AcAc indicates acetyl acetonate).

TABLE II

| Charge Control Agent[1] | Contact Potential[2] | Charging Characteristics[3] Tribo μC/g | Admix (minutes) | S |
|---|---|---|---|---|
| None | 0 | −5.4 | 5 | 2.1 |
| PS-b-POE/PAA$_{(\frac{1}{2})M}$ | −0.21 | −8.0 | 15 | 2.3 |
| PS-b-POE/PAA$_{(\frac{1}{2})M}$.$ZnCl_2$ | −0.09 | −4.6 | 0.5 | 0.86 |
| PS-b-POE/PAA$_{(\frac{1}{2})M}$.$AlCl_3$ | −0.10 | — | — | — |
| PS-b-POE/PAA$_{(\frac{1}{2})M}$.ZnAcAc | −0.24 | — | — | — |
| PS-b-POE/PAA$_{(\frac{1}{2})M}$.AlAcAc | −0.12 | −8.3 | 5 | 3.3 |

[1]Salt complexed @20 mole % based on one EO unit per mole.
[2]Kelvin type contact potential for ultra-thin films on Au, normalized to PS-b-POE film as zero.
[3]Toner comprised of copolymer of 89% styrene and 11% butadiene by wt./Permanent Yellow FGL/CCA (80/10/10) by wt. Roll mill tribo, vs carrier consisting of a ferrite core with a 0.8% by wt. coating of 20% by wt. of Vulcan carbon black and 80% by wt. of a methyl terpolymer comprised of 80.9% by wt. methylmethacrylate, 14.3% by wt. of styrene and 4.8% by wt. of vinyltriethoxy silane, toner concentration ~3% by wt.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated. In the following examples, the admix time sufficient to avoid background will vary with machine design, but generally roll mill admix times of one minute or less are preferred. Also, triboelectric values are determined by Faraday cage or charge spectrograph.

EXAMPLE 1

Preparation of an ionomeric block copolymer: Poly(styrene-block-butylacrylate/acrylic acid)

This ionomeric block copolymer can be prepared by sequential free-radical polymerization initiating the polymerization with the difunctional free-radical initiator 4-(t-butylperoxycarbonyl)-3-hexyl-6-[7-(t-butylperoxycarbonyl) heptyl] cyclohexene (Lupersol RS 606). In a typical procedure 522 grams of styrene is dissolved in 1400 ml of toluene along with 1 mole % Lupersol RS 606, based on the styrene component. The reaction is purged with Ar and polymerized under an Ar atmosphere at 80° C. for 16 hours. The resulting product is a mixture of "dead" poly(styrene) chains and poly(styrene) chains bearing active hydroperoxide end-groups. A portion (about 100 ml) of the 1st stage reaction is isolated by precipitation in methanol, which removes unpolymerized monomer. The methanol content of the precipitate is reduced to a minimum by filtration and partial drying and the wet filter cake, 28 g, (an amount containing 12.5 grams of functional, hydroperoxide-terminated, poly(styrene)), is dissolved in amyl acetate, 120 ml. Butyl acrylate (5.4 grams) and acrylic acid (5.4 grams) are added to the flask and the solution is purged with Ar. The polymerization of the second segment of the block copolymer is effected by raising the temperature of the ingredients to 105°–110° C. and holding at this temperature for 16 hours. The resulting product is a mixture of homopoly(styrene), copoly(butylacrylate/acrylic acid) and ~18 g of poly(styrene-block-butylacrylate/acrylic acid). While the mixture can be complexed with salt and used for control of charging characteristics in styrenic toner resins, isolation of the block copolymer fraction of the mixture may be the preferred course of action in regards to the use of salt complexes of poly(styrene-block-butylacrylate/acrylic acid) for control of charging characteristics. The block copolymer is isolated from the mixture by: (1) precipitation into hexane (ten fold excess of hexane); (2) extraction of the hexane precipitate with cyclohexane, a ten fold excess of cyclohexane with two extractions (a process which removes homopoly(styrene)); and (3) extraction of the residual material with methanol, a ten fold excess of methanol with two extractions (a process which removes copoly(butylacrylate/acrylic acid). The resulting isolated product, is comprised of PS, butylacrylate and acrylic acid residues in a ratio of (70/16/14) by weight. Salt is complexed to the block copolymer simply by dissolution of poly(styrene-block-butylacrylate/acrylic acid) in tetrahydrofuran and addition of the desired amount of salt (in a ratio of 0.25 mole salt/1 mole carboxylic acid) as a methanolic solution. The salt complexed poly(styrene-block-butylacrylate/acrylic acid) is isolated by precipitation in hexane.

EXAMPLE 2

Preparation of an interpolymer complex: Polystyrene-block-polyoxyethylene/polyacrylic acid Interpolymer complexes are typically prepared by mixing solutions of block copolymer and complexing homopolymer. The interpolymer complex can be isolated by precipitation into a nonsolvent for the system. In a representative procedure, PS-b-POE and PAA are dissolved separately in tetrahydrofuran and and mixed in a proportion which is suitable for function as a charge control agent. For use in preparation of negative charging toners a composition of PS-b-POE/PAA (⅓) molar based on the POE content would be appropriate. The solution containing the complexed polymer pair is then precipitated in hexane (ten fold excess of hexane) and dried to yield an additive suitable for melt mixing in a toner composition. If salt is to be bound to the interpolymer complex it is typically added as a methanolic solution to either of the polymer solutions or their complexed mixture. The salt complexed polymer is then isolated by precipitation in hexane.

EXAMPLE 3

Preparation of a positive charging toner composition containing an ionomeric block copolymer complexed with a salt: Pigment/Styrenic resin/poly(styrene-block-butylacrylate/2-acrylamido-2-methylpropane potassium sulfonate)

A toner composition is prepared by melt blending 80–93% of a styrene/butadiene (in a ratio of 89/11 by weight) polymeric resin available as Pliotone from Goodyear Chemical with 2–10% by weight of pigment PV-Fast Blue and 5–10% of poly(styrene-block-butylacrylate/2-acrylamido-2-methylpropane potassium sulfonate). The resulting mixture may then be attrited and classified to yield a toner composition which charges positively against any of a number of carriers. For instance, when this toner is blended with a carrier consisting of a ferrite core coated with a copolymer derived from fluorovinyl and chlorovinyl monomers (FPC 461, Firestone Plastics) and mixed a positive triboelectric charge of the order of 20 mcoul/g can be achieved. The admix of toner is rapid (<2 min as opposed to >15 min for a control toner which may be prepared the same way but without the ionomeric block copolymer).

Additional positive charging toners with a charge of the order of 20 mcoul/g may be obtained by repeating the above process with the exception that there is substituted for the poly(styrene-block-butylacrylate/2-acrylamido-2-methylpropane potassium sulfonate), the salt complexed ionomeric block copolymers illustrated herein such as PS-b-quaternized poly(vinyl pyridine) and PS-b-potassium carboxylate polymer.

EXAMPLE 4

Preparation of a positive charging toner composition containing a polyelectrolyte interpolymer complex: Pigment/Styrenic resin/poly(styrene-block-acrylic acid)/Ionene A toner composition is prepared by melt blending 80–93% of a styrene/butadiene (in a ratio of 89/11 by weight) polymeric resin available as Pliotone from Goodyear Chemical with 2–10% by weight of pigment PV-Fast Blue and 5–10% of poly(styrene-block-acrylic acid)/Ionene. The resulting mixture may then be attrited and classified to yield a toner composition which charges positively against any of a number of carriers. For example, when this toner is blended with a carrier consisting of a ferrite core coated with a copolymer derived from fluorovinyl and chlorovinyl monomers (FPC 461, Firestone Plastics) and mixed a positive triboelectric charge of the order of 20 mcoul/g can be achieved. The admix of toner is rapid (<2 min as opposed to >15 min for a control toner which may be prepared the same way but without the interpolymer.

Additional positive charging toners with a charge of the order of 20 mcoul/g may be obtained by repeating the above process with the exception that there is substituted for the poly(styrene-block-acrylic acid)/Ionene, the salt complexed ionomeric block copolymers illustrated herein such as PS-b-POE/PAA fractionally neutralized with alkali or alkaline earth metal hydroxides, PS-b-potassium carboxylate polymer, PS-b-PAA/-Poly(N-vinyl-2-pyrrolidone•salt, PS-b-PAA/Poly(acrylamide)•salt, PS-b-PAA/Poly(ethylene imine)•salt, PS-b-PAA/Quaternized poly(vinyl pyridine), and PS-b-PAA/Poly(ethyloxazoline)•salt.

EXAMPLE 5

Preparation of a negative charging toner composition containing an ionomeric block copolymer complexed with a salt or Lewis acid: Pigment/Styrenic resin/poly(styrene-block-butylacrylate/acrylic acid)•$ZnCl_2$ A toner composition is prepared by melt blending 80–93% of a styrene/butadiene (in a ratio of 89/11 by weight) polymeric resin available as Pliotone from Goodyear Chemical with 2–10% by weight of pigment PV-Fast Blue and 5–10% of poly(styrene-block-butylacrylate/acrylic acid)•$ZnCl_2$. The resulting mixture may then be attrited and classified to yield a toner composition which charges negatively against any of a number of carriers. For example, when this toner is blended with a carrier consisting of a ferrite core coated with a methyl terpolymer comprised of 80.9% methylmethacrylate, 14.3% by weight of styrene and 4.8% by weight of vinyltriethoxy silane and mixed a negative triboelectric charge of the order of −10 mcoul/g can be achieved. The admix of toner is rapid (<2 min as opposed to >15 min for a control toner which may be prepared in the same way but without the salt complexed ionomeric block copolymer.

Additional negative charging toners with a charge of the order of −10 mcoul/g may be obtained by repeating the above process with the exception that there is substituted for the poly(styrene-block-butylacrylate/acrylic acid)•$ZnCl_2$, the salt complexed ionomeric block copolymers illustrated herein such as PS-b-Fluoroacrylate/acrylic acid•Lewis acid salt.

EXAMPLE 6

Preparation of a negative charging toner composition containing an interpolymer complexed with a salt or Lewis acid: Pigment/Styrenic resin/poly(styrene-block-oxyethylene)/poly(acrylic acid)•$ZnCl_2$ A toner composition is prepared by melt blending 80–93% of a styrene/butadiene (in a ratio of 89/11 by weight) polymeric resin available as Pliotone from Goodyear Chemical with 2–10% by weight of pigment PV-Fast Blue and 5–10% of poly(styrene-block-oxyethylene)/poly(acrylic acid)•$ZnCl_2$. The resulting mixture may then be attrited and classified to yield a toner composition which charges negatively against any of a number of carriers. For example, when this toner is blended with a carrier consisting of a ferrite core coated with a methyl terpolymer comprised of 80.9% methylmethacrylate, 14.3% by weight of styrene and 4.8% by weight of vinyltriethoxy silane and mixed a negative triboelectric charge of the order of −10 mcoul/g can be achieved. The admix of toner is rapid (<2 min as opposed to >15 min for a control toner which may be prepared the same way but without the salt complexed interpolymer.

Additional negative charging toners with a charge of the order of −10 mcoul/g may be obtained by repeating the above process with the exception that there is substituted for the poly(styrene-block-oxyethylene)/poly(acrylic acid)•$ZnCl_2$, the salt complexed ionomeric block copolymers illustrated herein such as PS-b-POE/Nafion® Zn salt and PS-b-PAA/fluoroacrylate acrylic acid copolymer•Lewis acid salt. Nafion® is a perfluoroethylene sulfonate derivative.

Other modifications of the present invention may occur to those skilled in the art based upon a reading of the present disclosure and these modifications are intended to be included within the scope of the present invention.

We claim:

1. A toner composition comprised of resin particles, pigment particles, submicron colloidal domains of an ionomeric polymer or an interpolymer complex comprising a first polymer and a second polymer dispersed in the resin particles, and a Lewis acid, a salt, or an ion thereof attached to the ionomeric polymer or to the interpolymer complex.

2. An electrostatic toner composition comprising resin particles, pigment particles, and submicron colloidal domains of an ionomeric polymer dispersed in the resin particles, and a Lewis acid, a salt, or an ion thereof attached to the ionomeric polymer or to the interpolymer complex.

3. An electrostatic toner composition comprising resin particles, pigment particles, and submicron colloidal domains of an interpolymer complex comprising a first polymer and a second polymer dispersed in the resin particles, and a Lewis acid, a salt, or an ion thereof attached to the ionomeric polymer or to the interpolymer complex.

4. The toner compositions according to claim 1, wherein a portion of the ionomeric polymer or the interpolymer complex is adsorbed on the surface of the pigment particles.

5. The toner composition according to claim 1, wherein the cation of the salt or the ion thereof attached to the ionomeric polymer or to the interpolymer complex is a transition metal, an alkali metal, or an alkaline earth metal.

6. The toner composition according to claim 1, wherein the anion of the salt or the ion thereof attached to the ionomeric polymer or to the interpolymer complex is selected from the group consisting of halide, trifluoromethane sulfonic acid, hexafluorophosphate, hexafluorosilicate, carboxylate and oximate.

7. The toner composition according to claim 1, wherein the salt is an alkali metal hydroxide or an alkaline earth metal hydroxide.

8. The toner composition according to claim 1, wherein the ionomeric polymer is in a form of (F-block-G) wherein F and G are independently selected from the group consisting of a homopolymer, a copolymer, and a terpolymer.

9. The toner composition according to claim 1, wherein the ionomeric polymer is poly(styrene-block-butylacrylate/acrylic acid) complexed to a Lewis acid or a transition metal salt.

10. The toner composition according to claim 1, wherein the ionomeric polymer is poly(styrene-block-butylacrylate/2-acrylamido-2-methylpropane potassium sulfonate).

11. The toner composition according to claim 1, wherein the first polymer and the second polymer of the interpolymer complex are each a homopolymer.

12. The toner composition according to claim 1, wherein the first polymer and the second polymer of the interpolymer complex are independently selected from the group consisting of an ionophoric polymer and the ionomeric polymer.

13. The toner composition according to claim 1, wherein the first polymer of the interpolymer complex is in a form of (C-block-D) and the second polymer is a polymer E, wherein C, D, and E are independently selected from the group consisting of a homopolymer, a copolymer, and a terpolymer.

14. The toner composition according to claim 1, wherein the first polymer of the interpolymer complex is an ionophoric polymer and the second polymer is the ionomeric polymer.

15. The toner composition according to claim 1, wherein both the first polymer and the second polymer of the interpolymer complex are the ionophoric polymer, and wherein the first and second polymer are equivalent or dissimilar ionophoric polymers.

16. The toner composition according to claim 1, wherein both the first polymer and the second polymer of the interpolymer complex are the ionomeric polymer, and wherein the first and second polymer are equivalent or dissimilar ionomeric polymers.

17. The toner composition according to claim 1, wherein either the first or the second polymer of the interpolymer complex is polystyrene-block-polyoxyethylene.

18. The toner composition according to claim 1, wherein the interpolymer complex is polystyrene-block-poly(oxyethylene)/poly(acrylic acid) complexed with a salt or a Lewis acid selected from the group consisting of zinc chloride, aluminum chloride, zinc acetyl acetonate, and aluminum acetyl acetonate.

19. The toner composition according to claim 1, wherein the interpolymer complex is poly(styrene-block-acrylic acid)Ionene.

20. The toner composition according to claim 1, wherein the ionomeric polymer or interpolymer complex is present in an amount of less than about 20 percent by weight based on the weight of the toner composition.

21. The toner composition according to claim 1, wherein the colloidal domains have an average volume diameter of from about 100 to about 1000 Angstroms.

22. A developer composition comprising the toner composition of claim 1, and carrier particles.

23. The developer composition according to claim 22, wherein the carrier particles contain a coating.

24. The developer composition according to claim 22, wherein the carrier particles contain a coating of a complexed ionomeric polymer or a complexed interpolymer complex.

25. The developer composition according to claim 22, wherein the carrier particles contain a coating of a copolymer derived from fluorovinyl and chlorovinyl monomers.

26. The developer composition according to claim 22, wherein the carrier particles are steel or a ferrite.

27. A developer composition according to claim 22, wherein the toner composition has a positive charge.

28. A developer composition according to claim 22, wherein the toner composition has a negative charge.

* * * * *